US005678488A

United States Patent [19]

Yamaguchi et al.

[11] Patent Number: 5,678,488

[45] Date of Patent: Oct. 21, 1997

[54] PRINTING METHOD AND PRINTING APPARATUS

[75] Inventors: Naoto Yamaguchi; Hiroshi Ishida; Yukihiro Uchiyama; Masayuki Kumazaki; Kazuhiko Yamaguchi, all of Nagano, Japan

[73] Assignee: Seiko Epson Corporation, Tokyo, Japan

[21] Appl. No.: 613,917

[22] Filed: Mar. 11, 1996

[30] Foreign Application Priority Data

Mar. 23, 1995 [JP] Japan ..... 7-088609

[51] Int. Cl.[6] ..... B41J 13/02; B65H 9/04

[52] U.S. Cl. ..... 101/483; 271/242; 400/624

[58] Field of Search ..... 400/624; 271/10.01, 271/229, 236, 242, 110, 10.12, 10.03, 270; 101/483

[56] References Cited

U.S. PATENT DOCUMENTS

| | | | |
|---|---|---|---|
| 5,085,420 | 2/1992 | Sata | 271/114 |
| 5,222,724 | 6/1993 | Hirano et al. | 271/10 |
| 5,226,741 | 7/1993 | Kumazaki et al. | 400/579 |
| 5,246,224 | 9/1993 | Matsuno et al. | 271/242 |
| 5,362,038 | 11/1994 | Giles et al. . | |
| 5,415,387 | 5/1995 | Suzuki | 271/10 |

FOREIGN PATENT DOCUMENTS

| | | | |
|---|---|---|---|
| 58-6633 | 2/1983 | Japan . | |
| 62-38261 | 8/1987 | Japan . | |
| 62-244846 | 10/1987 | Japan | 271/242 |
| 3-243556 | 10/1991 | Japan | 271/242 |
| 2 055 768 | 3/1981 | United Kingdom . | |
| 2 238 301 A | 5/1991 | United Kingdom . | |

*Primary Examiner*—Edgar S. Burr
*Assistant Examiner*—Dave Ghatt
*Attorney, Agent, or Firm*—Stroock & Stroock & Lavan LLP

[57] ABSTRACT

A printing method of playing out piled sheets of paper one by one, feeding the played-out sheet of paper to the position of a platen, and printing the sheet of paper, the printing method includes the steps of: (a) feeding the sheet of paper played out from the piled position thereof at a first speed until the sheet of paper approaches a platen which is stopping; (b) feeding the sheet of paper at a second speed lower than the first speed until a required short time passes from a time when the sheet of paper is engaged with the stopping platen, for performing a sheet flexing and a sheet skew removing; and (c) driving the platen at the second speed to feed the sheet of paper to a printing position. And the printing apparatus performs the printing method.

8 Claims, 10 Drawing Sheets

PRINTING METHOD AND PRINTING APPARATUS

BACKGROUND OF THE INVENTION

The present invention relates to a printing method which feeds piled sheets of paper one by one separately to a printing position, and a printing apparatus which performs the printing method.

Conventionally, as a technique of the type which feeds piled printing sheets of paper one by one separately, there have been disclosed in, for example, the specification of the U.S. Pat. No. 5,362,038 (which is referred herein to as a known technique (A)), Japanese Patent Publication No. Sho. 58-6633 (which is herein referred to as a known technique (B)), and Japanese Patent Publication No. Sho. 62-38261 (which is herein referred to as a known technique (C)).

In the above-mentioned known technique (A), the piled sheets of paper are separated one by one by sheet feed rollers 12 and 14 and the leading end of the thus separated sheet of paper is contacted with cutting tools 26 and 28 at a same speed as the separating speed of the sheet feed rollers 12 and 14. Also, in the known technique (B), a sheet of paper is fed while a platen is being rotated reversely, the sheet of paper is further fed even after the leading end of the sheet of paper reaches a pressure contact portion between the platen and driven roller and is prevented from advancing further, thereby causing the sheet of paper to flex so as to eliminate the skew of the sheet, and, after then, the platen is rotated forwardly to send the sheet to a print starting position. Further, in the known technique (C), piled sheets of paper are fed one by one by a pickup roller rotating forwardly to a drive roller which is rotating forwardly, if it is detected by a sensor that the leading end of the paper has completely passed this pair of rollers, then the pickup roller is caused to stop and, at the same time, the drive roller is rotated reversely to push back the sheet of paper until the leading end of the paper is discharged out from the drive roller, thereby causing the sheet of paper to flex so as to eliminate the skew of the sheet, and, after then, the drive roller is rotated forwardly to feed the sheet of paper to a print starting position.

Although the above known techniques (A), (B) and (C) has no serious problems concerning the print sheet feeding, there are still left the following problems to be solved.

That is, in the known technique (A), if the sheet of paper is fed at a high speed, then there is a fear that, when the leading end of the sheet of paper is contacted with the cutting tools 26 and 28, the leading end of the sheet of paper can be folded; and, if the sheet is fed at a low speed in order to eliminate this fear, then the general speed (throughput) necessary to carry out a series of processing including the sheet separating processing to the skew removing processing is delayed, which inevitably lowers the printing efficiency. In the known technique (B), since the leading end of the sheet of paper 106 is abutted against the pressure contact portion between the platen and driven roller while they are both rotating reversely, as shown in FIG. 10(*a*) to 10(*c*), the leading end of the sheet of paper can be caught between the platen 101 and driven roller 102 and can be thereby folded easily when the sheet of paper is abutted against the platen 101 and driven roller 102 in various manners, which lowers the reliability of the sheet feeding processing. In the known technique (C), not only since, in order to detect the leading end of the sheet of paper by the sensor, the sheet of paper is fed until the leading end of the sheet of paper has passed the drive roller completely, before the sheet is fed back, but also since the sheet feed roller is caused to stop when the drive roller is rotated reversely to thereby cause the sheet to flex, the flexing of the sheet of paper must be carried out only by the amount of reverse rotation of the drive roller, which requires a long time to flex the sheet. Accordingly, the throughput of this known technique is lowered and the structure thereof becomes complicated.

SUMMARY OF THE INVENTION

In view of the these circumstances, the present invention aims at eliminating the above-mentioned drawbacks found in the conventional techniques. Accordingly, it is a first object of the invention to provide a printing method and printing apparatus which can prevent a sheet of paper from being folded and can perform positively a processing for removing the skew of the sheet of paper.

It is a second object of the invention to provide a printing method and printing apparatus which can perform a sheet feeding processing at a higher speed and with a higher reliability.

It is a third object of the invention to provide a printing apparatus which is simplified in structure.

According to a first aspect of the invention to achieve the object, there is provided a printing method of playing out piled sheets of paper one by one, feeding the played-out sheet of paper to the position of a platen, and printing the sheet of paper, the printing method comprising the steps of: (a) feeding the sheet of paper played out from the piled position thereof at a first speed until the sheet of paper approaches a platen which is stopping; (b) feeding the sheet of paper at a second speed lower than the first speed until a required short time passes from a time when the sheet of paper is engaged with the stopping platen, for performing a sheet flexing and a sheet skew removing; and (c) driving the platen at the second speed to feed the sheet of paper to a printing position.

According to a second aspect of the invention, there is provided the printing method according to the first aspect, wherein the platen is driven at a third speed lower than the second speed in the step (c).

According to a third aspect of the invention, there is provided a printing apparatus comprising: a sheet feed roller for playing out piled sheets of paper one by one; a platen disposed at a downstream side of a sheet feed passage than the sheet feed roller; a driven roller contact with the platen; a sheet feed auxiliary roller disposed at the sheet feed passage between the sheet feed roller and the platen, for energizing the feed of the sheet of paper; sheet detecting means disposed on the sheet feed passage between the sheet feed roller and the platen, for detecting that the sheet of paper approaches the platen; and driving means for forcibly driving the platen, sheet feed roller and sheet feed auxiliary roller, wherein the sheet of paper is fed at a first speed by the driving means until the sheet of paper is detected by the sheet detecting means, and, after the passage of a required short time from a time when the leading end of the sheet of paper is engaged with the platen which is stopping, the platen is driven at a second speed lower than the first speed to feed the sheet of paper to a printing position.

According to a fourth aspect of the invention, there is provided the printing apparatus according to the third aspect, wherein the driving means drives the sheet feed roller at the first speed and the sheet feed auxiliary roller at the first speed, at the second speed, and at a third speed lower than the second speed.

According to a fifth aspect of the invention, there is provided the printing apparatus according to the third aspect, wherein the driving means drives the platen at the second or third speed.

According to a sixth aspect of the invention, there is provided the printing apparatus above described, wherein the feed force of the sheet feed auxiliary roller is set larger than that of the sheet feed roller by the driving means.

According to the invention, the piled sheets of paper are played out one by one at a high speed by the sheet feed roller, the sheet of paper is further energized by the sheet feed auxiliary roller to approach the platen at a high speed, the leading end of the sheet of paper is engaged at an intermediate speed with the stopping platen by means of detection of the sheet of paper by the sheet detecting means, until the required short time has passed from the engagement time, the sheet of paper is fed at a middle speed to thereby flex the sheet of paper and remove the skew of the sheet of paper, and next the platen is driven at the intermediate speed or at a low speed to thereby feed the sheet of paper to a printing position.

DETAILED DESCRIPTION OF THE PREFERRED EMBODIMENTS

Next, description will be given below of the embodiments of the invention with reference to the accompanying drawings.

1. Sheet feed part

Figure 8:
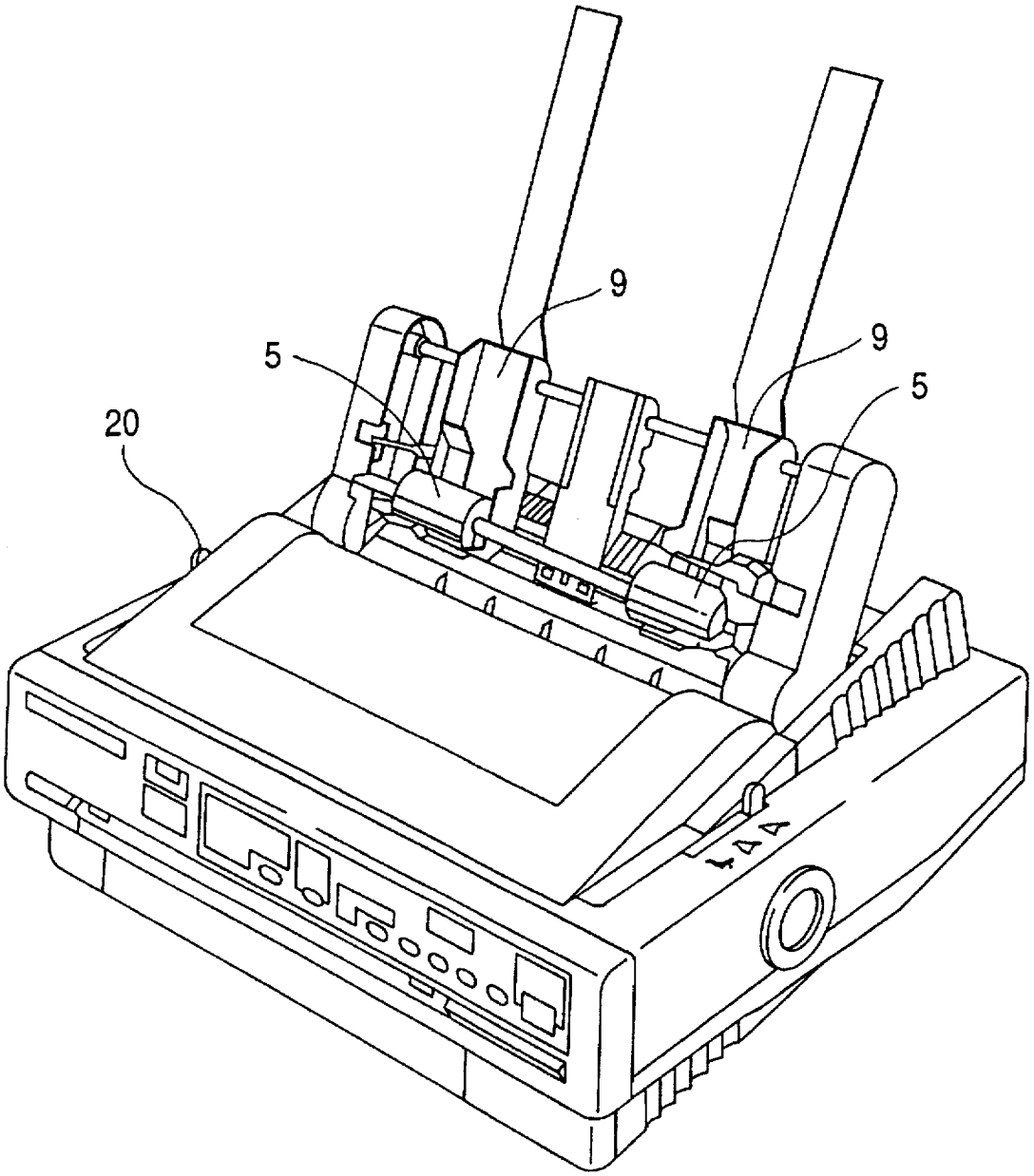
FIG. 8 is a perspective view of the outer appearance of an embodiment of a printing apparatus according to the invention.

FIG. 8 shows a printing apparatus according to the invention, in which a sheet of paper 6 to be fed from a sheet storage part 9 can be forwarded by a sheet feed roller 5 in a direction of a platen 1 to be described later. By operating a control lever 20 manually, the distance between the platen 1 and a print head 8 is changed or controlled to fit it to the thickness of the sheet of paper 6. Also, by detecting the position of the control lever 20 by use of a microswitch incorporated in the printing apparatus, a distance set between the platen 1 and print head 8 can be recognized.

Figure 1:
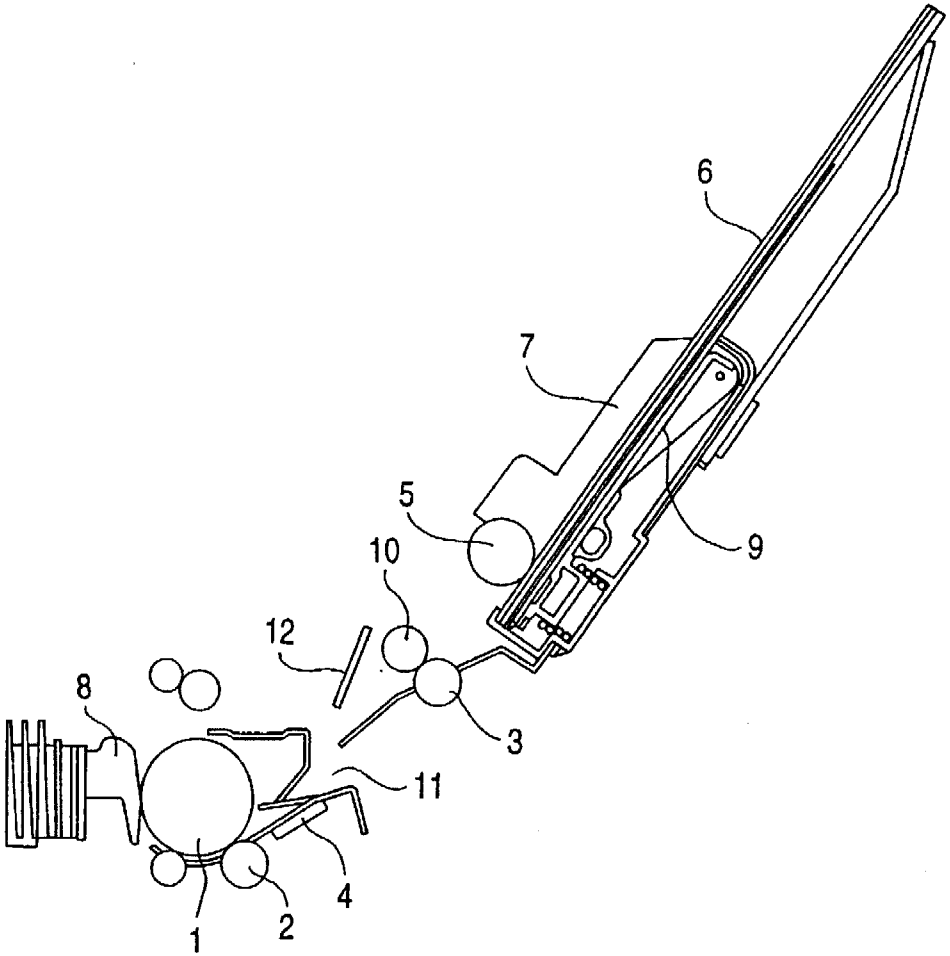
FIG. 1 is a section view .of the main portions of an embodiment according to the invention.

FIG. 1 shows a sheet feed passage extending from an automatic sheet feed device 7, which has a function to separate and feed piled sheets of paper one by one, to the print head 8 and, in this sheet feed passage, there is provided a sheet storage part 9 supporting the sheet of paper 6 and, in the leading end of the sheet storage part 9, there is disposed a sheet feed roller 5 for sending out the sheet of paper 6. Further, on the printer main body side situated downwardly of the sheet feed roller 5, there is provided a sheet feed auxiliary roller 3 with which an auxiliary driven roller 10 is in pressure contact. On the other hand, in the printer main body, a driven roller 2 formed of elastic material is in pressure contact with the platen 1. Also, between a sheet insertion opening 11 of the printer main body and driven roller 2, there is disposed sheet detect means 4 (microswitch) which is used to check whether the sheet of paper is present or absent.

Next, description will be given below of the operation of the above-mentioned structure.

Figure 2:
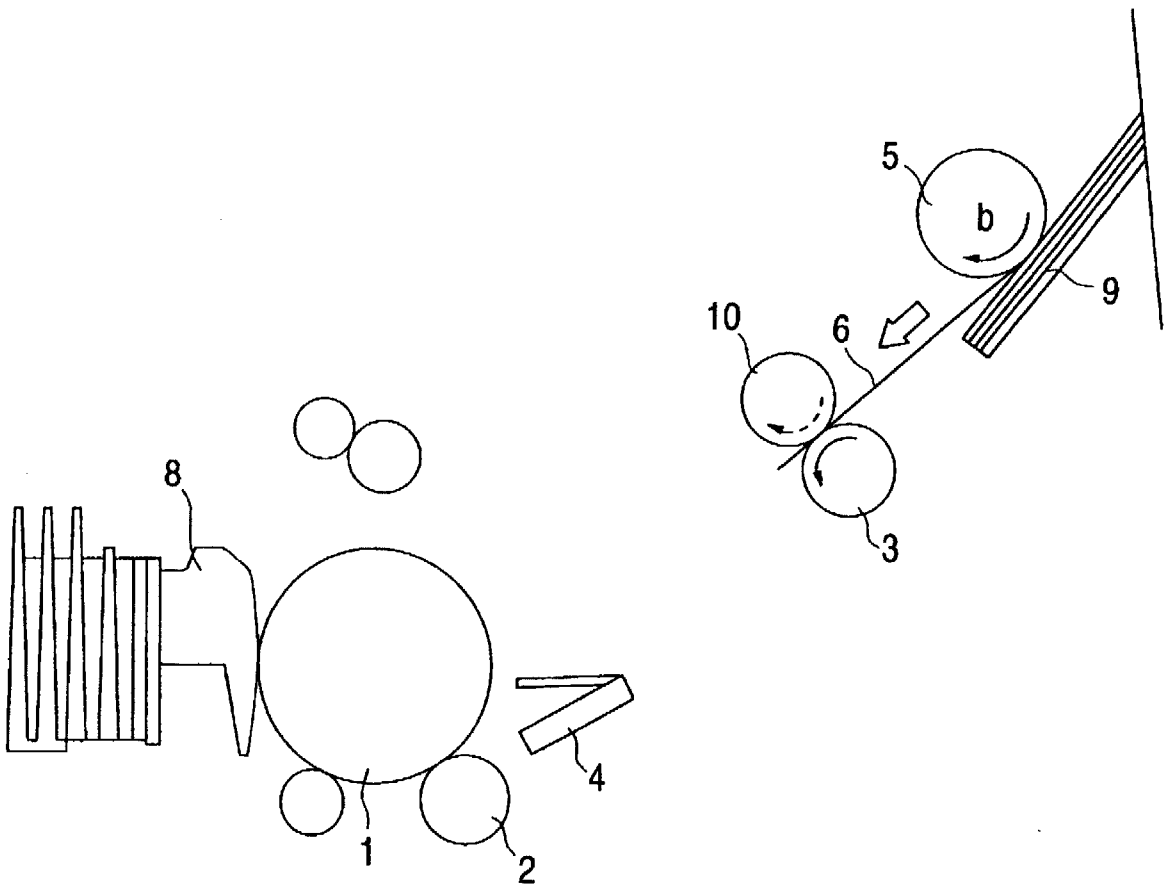
FIG. 2 is a view of a feed state in a first step of feeding a sheet of paper.
Figure 3:
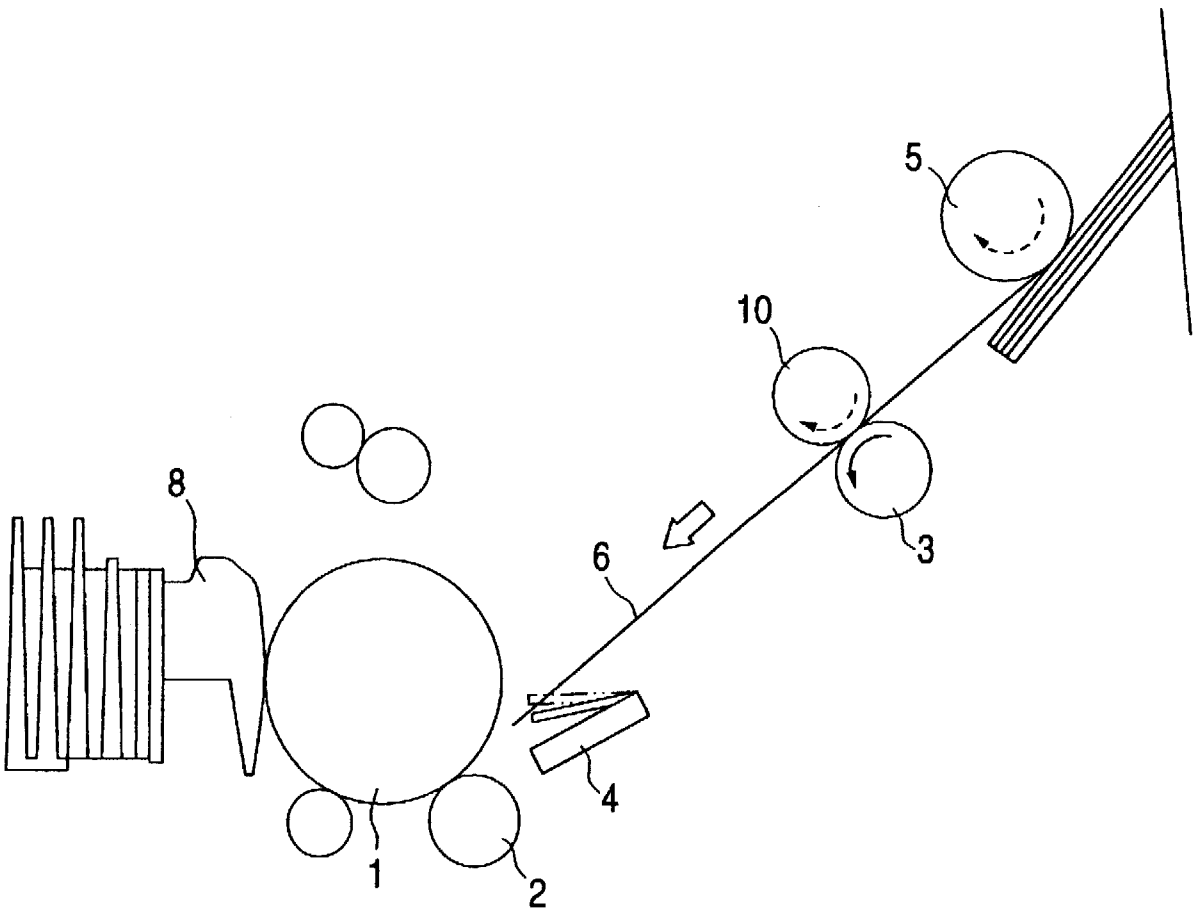
FIG. 3 is a view of a feed state in a second step of feeding the sheet of paper.

As shown in FIG. 2, if a paper feed drive motor (not shown) of drive means (not shown) is rotated forwardly, then the sheet feed roller 5, which is rotatable by planetary gear means to be discussed later, is rotated in a direction of an arrow (b). Thereby, a sheet of paper 6 which is situated at the highest position of the sheets of paper piled within the sheet storage part 9 can be separated from the remaining sheets of paper and can be then fed (see FIG. 2). The separated sheet of paper 6 is fed by the rotation of the sheet feed roller 5 until it bites into between the sheet feed auxiliary roller 3 and auxiliary driven roller 10. The amount of feed of the sheet of paper at the then time is regulated by the number of drive pulses to be applied to a drive motor comprising a stepping motor in accordance with a sheet feed passage length extending from the point of contact between the sheet feed auxiliary roller 3 and auxiliary driven roller 10 to the sheet feed roller 5. After then, if the sheet feed drive motor is rotated reversely, then the sheet of paper 6 is fed by the sheet feed auxiliary roller 3 and auxiliary driven roller 10 through a planetary gear mechanism to be discussed later, and the position of the leading end of the sheet of paper 6 is detected by the sheet detect means 4 (see FIG. 3).

The sheet feed is caused to stop or the speed of the sheet feed is changed here. The sheet feed speed may be high, provided that it is within the allowable range of the detect position accuracy of the leading end of the sheet of paper 6.

Figure 4:
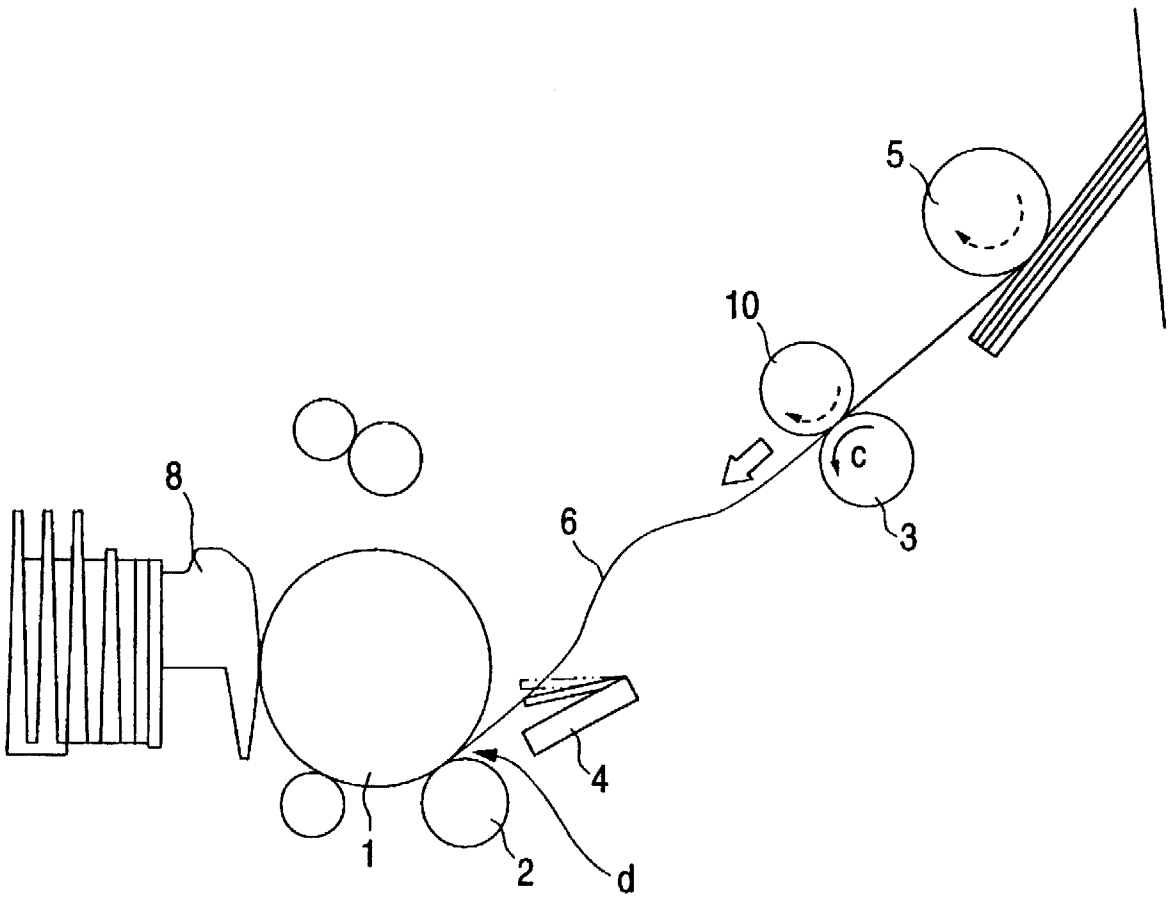
FIG. 4 is a view of a feed state in a third step of feeding the sheet of paper.

After detection of the leading end of the sheet of paper 6, in order to be able to flex the sheet of paper 6 without causing the sheet leading end to be folded, the sheet feed auxiliary roller 3 further keeps on rotating a given amount in a direction of an arrow (C) to feed the sheet of paper. The sheet of paper 6 is pushed excessively by a given amount not only against the platen 1 which is now stopping but also against the driven roller 2 which is pressed against the platen 1, thereby causing the sheet of paper 6 to flex (see FIG. 4). In other words, after the sheet leading end is detected by the sheet detect means 4, while the sheet of paper 6 is brought into contact with the platen 1 and driven roller 2 until the sheet feed is stopped, the amount of feed of the sheet of paper is regulated by the number of drive pulses to be applied to the sheet feed drive motor in accordance with not only the sheet passage length between the point of contact of the platen 1 with the driven roller 2 and the sheet detect means 4 but also a given amount of flexing to be produced in the sheet of paper 6. Due to this, the sheet of paper 6 can be flexed as shown in FIG. 4.

Figure 5:
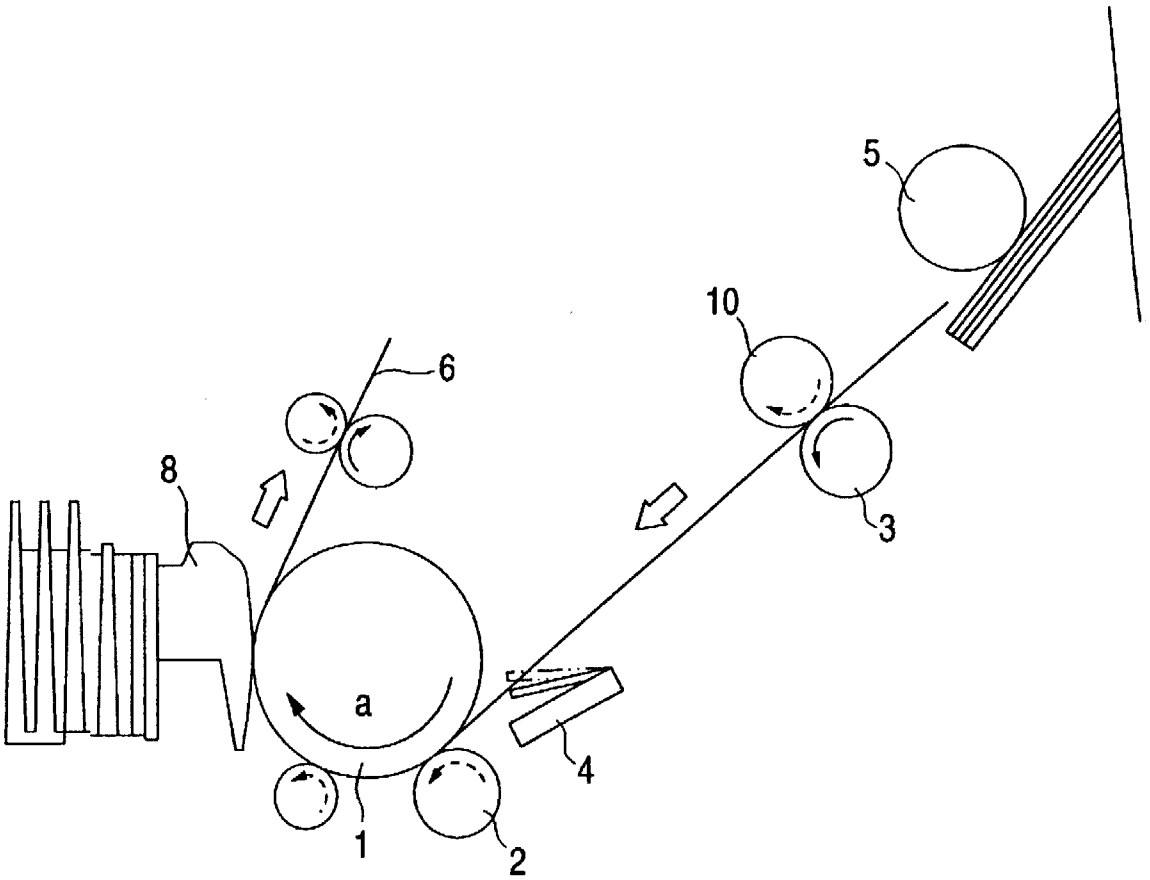
FIG. 5 is a view of a feed state in a fourth step of feeding the sheet of paper.
Figure 9:
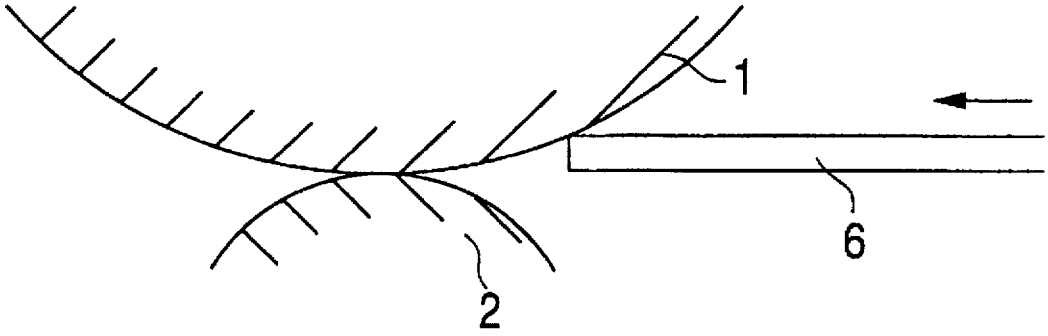
FIGS. 9(*a*) and 9(*b*) show how to flex a sheet of paper according to the invention.
Figure 9:
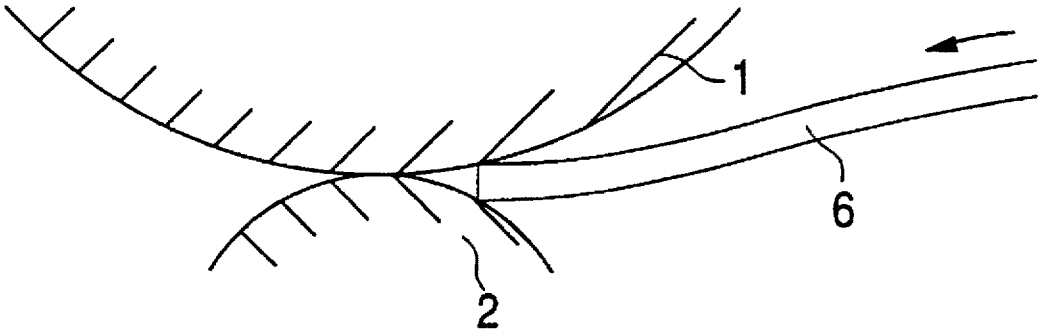
Figure 10:
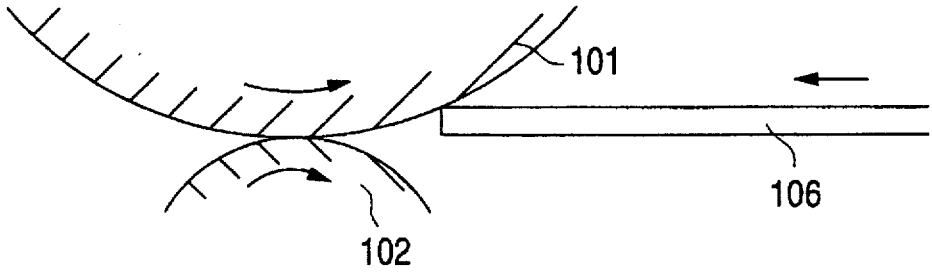
FIGS. 10(*a*) to 10(*c*) show how to flex a sheet of paper according to the conventional one.
Figure 10:
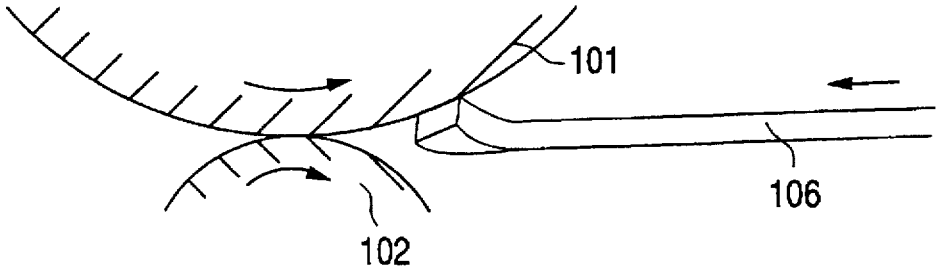
Figure 10:
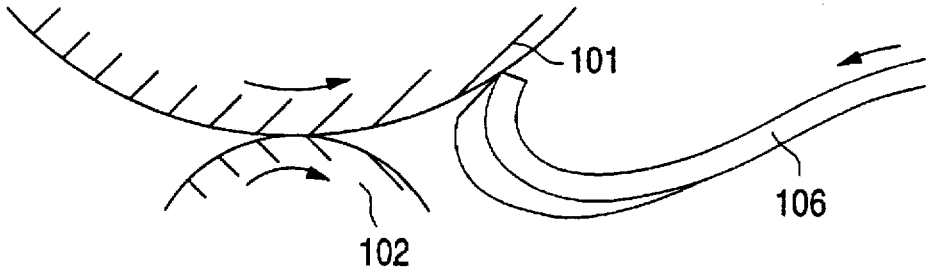

Since the flexed sheet of paper 6 pushes the leading end thereof against a point (d) at which the platen 1 and driven roller are in contact with each other, the leading end of the sheet of paper 6 can be arranged in the longitudinal direction of the platen 1, which can prevent the sheet of paper 6 from skewing. That is, since the sheet of paper 6 is allowed to flex in this manner, even if the leading end of the sheet of paper 6 fed can be abutted against the point (d) of contact between the platen 1 and driven roller 2 unevenly to a certain extent, as shown in FIG. 9, the sheet of paper 6 can be flexed stably without causing the leading end of the sheet of paper to be folded, which makes it possible to reduce greatly the time necessary between the separation and flexing of the sheet of paper 6. According to the present structure, at a time when a given amount of flexing is produced in the sheet of paper 6, the platen 1 is rotated in a direction of an arrow (a) shown in FIG. 5 to thereby feed the sheet of paper 6 to a printing position. The speed of this sheet feed may be preferably changed according to the thicknesses of the sheets of paper to be fed in such a manner that a sheet of paper having a large thickness can be fed at a low speed and a sheet of paper having a small thickness can be fed at a high speed.

2. Gear train part

Figure 6:
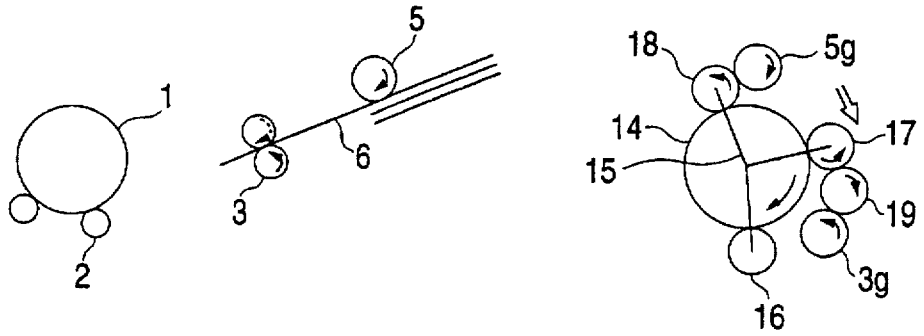
FIGS. 6(*a*) to 6(*d*) are views of the sheet feed states and the operations of a gear train in the embodiment according to the invention.
Figure 6:
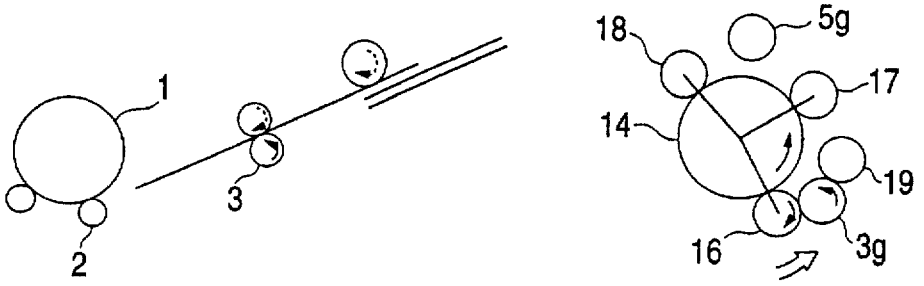
Figure 6:
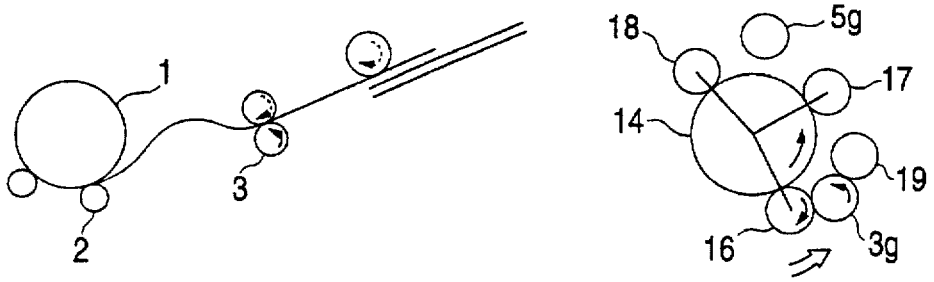
Figure 6:
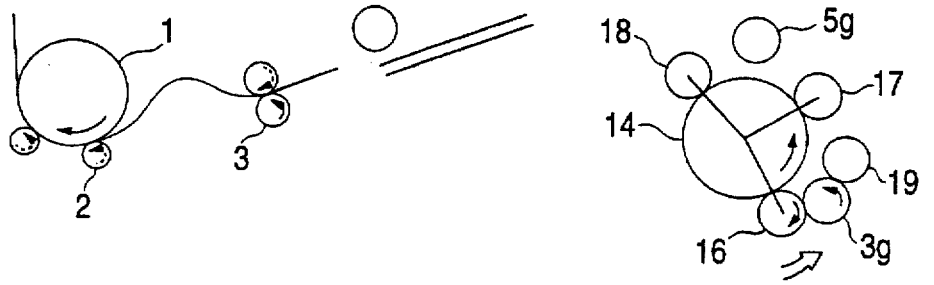

A gear train part of the present printing apparatus is shown in FIGS. 6(*a*) to 6(*d*). A drive gear 14 is driven by a sheet feed drive motor (not shown). First, second and third planetary gears 16, 17 and 18, which are connected integrally with one another by a common three-forked lever 15, are in mesh with the drive gear 14 in such a manner that they can roll on the periphery of the drive gear 14. When the drive gear 14 is rotated reversely (in FIG. 6(*b*), it is rotated counterclockwise), a drive force can be transmitted to a sheet feed auxiliary gear 3*g* as a forward rotation by the first planetary gear 16 which is circled counterclockwise together with the rotation of the drive gear 14 (such condition is shown in FIG. 6 (*b*), (*c*), and (*d*)). On the other hand, when the drive gear is rotated forwardly, a drive force can be transmitted to a sheet feed gear 5*g* as a forward rotation by the third planetary gear 18 which is revolved clockwise in FIG. 6(*a*), while the drive force can be transmitted to the sheet feed auxiliary gear 3*g* as a forward rotation by the second planetary gear 17 through an idler gear 19 (such condition is shown in FIG. 6 (*a*)).

3. Paper feed operation

Next, description will be given below of the associated operations of the sheet feed part and gear train part with reference to FIGS. 6(*a*) to 6(*d*) and a time chart shown in FIG. 7.

In this time chart, the uniform speeds of a sheet feed drive motor rotation speed (MDV), a sheet feed roller drive speed (RDV), a sheet feed auxiliary roller drive speed (RFV), a platen drive speed (PDV), and a sheet feed speed (SFV) are respectively set as high speeds ($V_1$), ($V_2$), middle speeds ($V_3$), ($V_4$), and low speed ($V_5$), while the respective uniform speeds include the rising and falling portions thereof at the sheet feed start time ($T_1$), the time ($T_2$) when the leading end of the sheet of paper 6 reaches the sheet feed auxiliary roller 3, the time ($T_3$) when the sheet of paper 6 is detected by the sheet detect means 4, the time ($T_4$) when the leading end of the sheet of paper 6 reaches the point of contact between the platen 1 and driven roller 2, and the time ($T_5$) when the platen 1 is rotated to thereby draw in the sheet of paper 6 in a direction of the printing position. In the present embodiment, the respective speeds ($V_1$)–($V_5$) are set in the following manner:

High speed ($V_1$)—6 in./sec. (inches per a second) (If this high speed is higher than this, then there is a fear that sheets of paper can be fed in a piled condition or a sheet of paper can slip off to fail to feed the sheet of paper properly.)

High speed ($V_2$)—5–6 in./sec.

Middle speed ($V_3$)—5 in./sec. (This middle speed may be preferably 5 in./sec. or less in order to make sure to flex the sheet.)

Middle speed ($V_4$)—5 in./sec.

Low speed ($V_5$)—3.3 in./sec.

Figure 7:
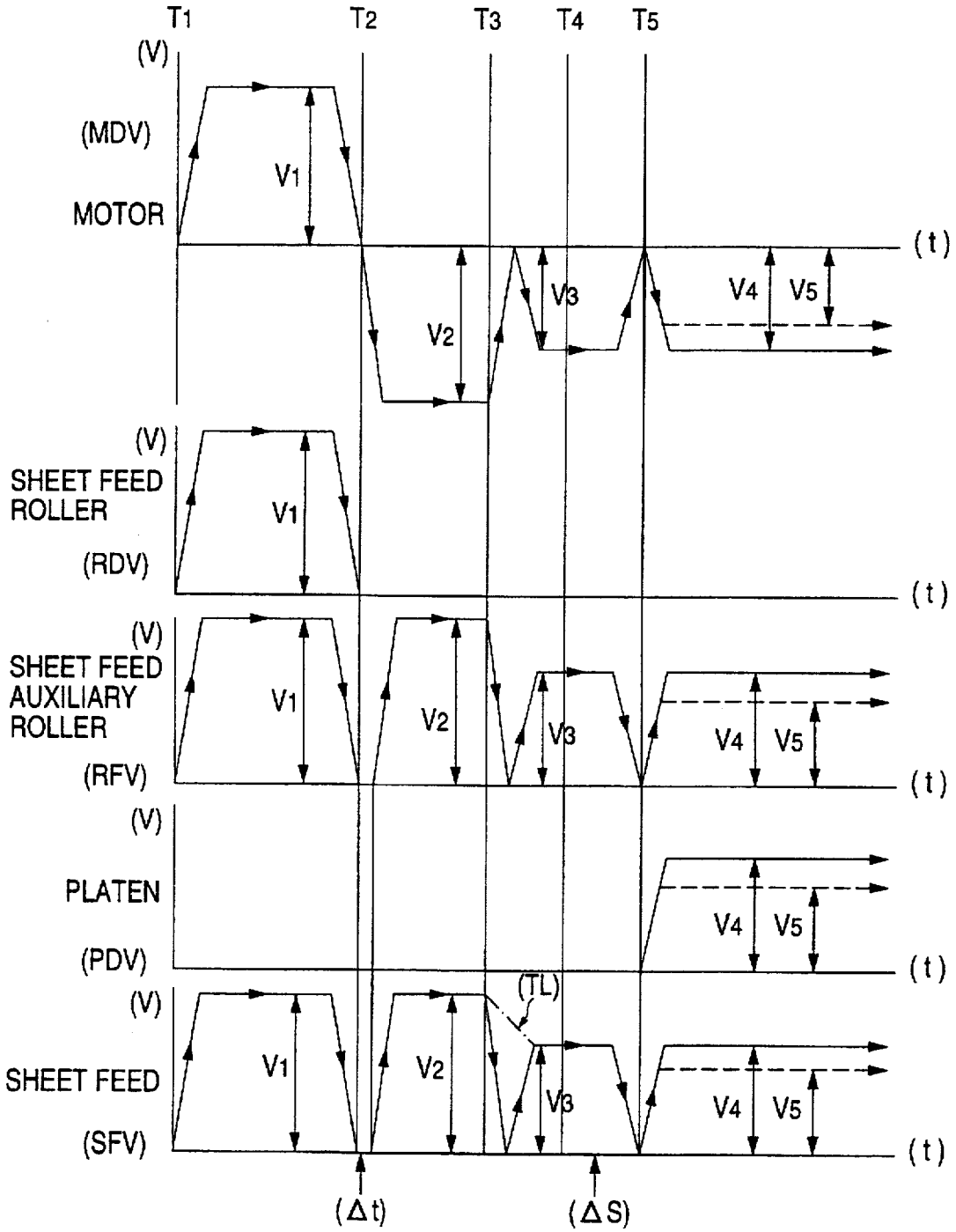
FIG. 7 is time charts of the sheet positions and the operations of the rollers in the embodiment according to the invention.

Also, in FIG. 7, $\Delta t$ expresses a minute time required to change the driving direction of the planetary gear, and $\Delta S$ expresses a minute distance by which the paper 6 is fed excessively in order to cause the sheet of paper 6 to flex.

Next, description will be given below of the operation when the sheet of paper 6 is a thin sheet of paper with reference to a time chart shown in FIG. 7.

At the paper feed start time ($T_1$), the paper feed drive motor starts to rotate under a condition that the rotation speed (MDV) thereof is the high speed ($V_1$). The drive gear 14 starts to rotate forwardly. The second planetary gear 17, which is situated at a position at which it has arrived after it was rotated clockwise on the periphery of the drive gear 14, transmits a forward rotation drive force to the sheet feed auxiliary gear 3*g* through the idler gear 19. The third planetary gear 18 similarly transmits a forward rotation drive force to the sheet feed gear 5*g*, whereby the sheet feed roller 5 is operated in such a manner that the sheet feed roller drive speed (RDV) thereof is the high speed ($V_1$) and the sheet feed auxiliary roller 3 is operated in such a manner that the drive speed (RFV) is also the high speed ($V_1$), so that the sheet of paper 6 is sent out under the high speed ($V_1$) condition.

This paper feed operation advances and, at the time ($T_2$) when the leading end of the sheet of paper 6 approaches the sheet feed auxiliary roller 3, the drive motor is switched over to reverse rotation and is similarly operated at the high speed ($V_2$). Thereby, the first planetary gear 16, which has switched over to the counterclockwise rotation and is revolved for the time $\Delta t$, meshes with the sheet feed auxiliary gear 3*g* to transmit a forward rotation drive force to the sheet feed auxiliary roller 3, causing the sheet feed auxiliary roller 3 to perform a sheet feed operation at the high speed ($V_2$). After then, the leading end of the sheet of paper 6 passes the sheet detect means 4 and reaches the point of contact between the platen 1 and driven roller 2 (time ($T_4$)) and, due to detection by the sheet detect means 4, the speed (RFV) of the sheet feed auxiliary roller 3 is switched from the high speed ($V_2$) over to the middle speed ($V_3$), so that the sheet of paper 6 is abutted against the point of contact between the platen 1 and driven roller 2 at a rather low speed and is thereby prevented against further advancement. However, since the sheet of paper 6 is further fed by a given minute distance ($\Delta S$), a required amount of flexing is produced in the sheet of paper 6 between the platen 1 and sheet feed auxiliary roller 3.

Due to this, though it is a thin sheet of paper, the leading end of the sheet of paper 6 can be adjusted properly in the axial direction (longitudinal direction) of the platen 1 due to a back tension peculiar to the sheet of paper 6, with the result that the skew of the sheet of paper 6 can be removed.

Next, at the time ($T_5$) when the skew of the sheet of paper 6 is removed in the above-mentioned manner, the sheet of paper 6 is fed in such a manner that the speed (PDV) of the platen 1 is set as the middle speed ($V_4$) and the speed (RFV) of the sheet feed auxiliary roller 3 is also set as the middle speed ($V_4$), whereby the sheet of paper 6 is transferred in the direction of the print head 8 with the sheet feed speed (SFV) as the middle speed ($V_4$), so that the sheet of paper 6 can be printed.

On the other hand, when the sheet of paper 6 is a thick sheet of paper, the feed processing of the sheet of paper after completion of the skew removal processing may be performed at a slower speed than the case where the sheet of paper 6 is a thin sheet of paper. That is, setting the above-mentioned motor rotation speed (MDV), auxiliary roller drive speed (RFV) and platen drive speed (PDV) respectively as the low speed ($V_5$) which, as shown by a dotted line in FIG. 7, is further slower than the middle speed ($V_4$) of the sheet feed speed (SFV) of the thin sheet of paper 6, so that the sheet of paper 6 can be fed safely and positively.

In order to execute a positive sheet feed operation, in the present embodiment, there are provided in combination the sheet feed roller 5 and sheet feed auxiliary roller 3 which are different in the sheet feeding capacity from each other. As a result of this, even if the sheet feed force of the sheet feed auxiliary roller 3 is increased, the sheet feed roller 5 exists separately as means for separating a sheet of paper from the remaining piled sheets of paper and, therefore, there is no fear that the paper 6 can be played out in a piled layer including two or more sheets of paper.

Also, in the present embodiment, there are provided two sets of sheet feed rollers 5 and the force of the sheet feed rollers 5 for pressing against the paper 6 is set as 320–210 grams per set, while the force of the sheet feed rollers 5 for feeding the sheet of paper 6 is set for 650–550 (gf) as a total of 2 sets. On the other hand, there are provided 4 sets of pairs of sheet feed auxiliary rollers 3 and 10 and the force of the sheet feed auxiliary rollers 3 and 10 for holding the sheet of paper 6 between them is set for 185 grams per set, while the sheet feeding force thereof is set for 814 (gf) as a total of 4 sets. If the pressing force of the sheet feed roller 5 is too strong, then there is a possibility that two or more sheets of paper can be fed together. On the other hand, the holding forces of the pairs of sheet feed auxiliary rollers 3 and 10 can be set relatively strong according to cases. That is, due to the fact that the pairs of sheet feed auxiliary rollers 3 and 10 are provided separately from the sheet feed rollers 5, the paper can be fed positively with no possibility that two or more sheets of paper can be fed together.

Alternatively, as shown by an imaginary line (TL), when the feed speed of the sheet of paper 6 is to be changed, of course, the drive means may be controlled in such a manner that the sheet feed speed can be decelerated to the middle speed ($V_3$) without stopping temporarily.

According to the present embodiment, since the above-mentioned structure is used to feed the sheet of paper, an operation to cause the sheet of paper 6 to flex can be executed at a high speed and with a high accuracy, and there is eliminated the possibility that the leading end of the sheet of paper can be folded even if the leading end portion of the sheet of paper 6 is abutted against the driven roller 2 and platen 1 in various ways, thereby being able to improve the feeding accuracy with which the sheet of paper 6 is fed to its print start position.

Also, as in the known technique (B), if the sheet detect means 4 is positioned downstream of the sheet feed passage of the pair of rollers for flexing the sheet of paper by use of the reversed rotation of the platen, then when the sheet of paper is manually inserted through a sheet insertion opening formed in a printer main body, it is impossible to check whether the sheet of paper is present or absent by use of the sheet detect means 4, which worsens the operationability of the sheet of paper. On the other hand, according to the present embodiment, even if the sheet of paper 6 is manually inserted along a hand-operated sheet guide 12 toward the sheet insertion opening 11, it is possible to check whether the sheet of paper is present or not by use of the sheet detect means 4, which makes it possible to eliminate the possibility that the operationability of the sheet of paper 6 can be worsened.

Also, acceding to the present embodiment, when the sheet of paper 6 is sent obliquely, if the amount of feed ΔS by which the sheet is fed excessively for the purpose of production of flexing is set such that it becomes a small value (1–5 mm) almost equivalent to a degree of the oblique of the sheet of paper 6, then the sheet feed speed can be increased further.

The remarkable effects that can be provided by the present invention are as follows:

(1) Positive removal of paper skew.

Due to the fact that the sheet of paper with the leading end thereof secured at the platen position is fed forcibly by the sheet feed auxiliary roller which energizes the feed of the sheet of paper, various kinds of sheets of paper having different characters can be flexed stably, whereby not only there is eliminated the possibility that the sheet of paper can be folded but also the positive removal of the sheet skew can be executed in a short time.

(2) Increase in speed and improvement in reliability of sheet feed processing.

Since there are provided the sheet feed roller and sheet feed auxiliary roller in combination and the sheet feed force of the sheet feed auxiliary roller is set greater than that of the sheet feed roller, the play-out of the sheet as well as the engagement of the sheet with the platen can be executed positively, which results in the increased speed and improved reliability of the sheet feed processing.

(3) Simplification in structure.

Because the platen, sheet feed roller and sheet feed auxiliary roller can be all driven in a single direction by the drive means, the structure of the present printing apparatus can be simplified greatly, which can facilitate the production of compact equipment as well as the maintenance thereof.

What is claimed is:

1. A printing method of playing out piled sheets of paper one by one, feeding the played-out sheet of paper to the position of a platen, and printing the sheet of paper, the printing method comprising the steps of:

(a) feeding the sheet of paper played out from the piled position thereof at a first speed in a downstream direction until the sheet of paper approaches a platen which is stopped;

(b) feeding the sheet of paper at a second speed in the downstream direction lower than the first speed until a required short time passes from a time when the sheet of paper is engaged with the stopped platen, for performing a sheet flexing and a sheet skew removing; and (c) driving the platen at the second speed in the downstream direction to feed the sheet of paper to a printing position.

2. A printing method of playing out piled sheets of paper one by one, feeding the played-out sheet of paper to the position of a platen, and printing the sheet of paper, the printing method comprising the steps of:

(a) feeding the sheet of paper played out from the piled position thereof at a first speed until the sheet of paper approaches a platen which is stopped;

(b) feeding the sheet of paper at a second speed lower than the first speed until a required short time passes from a time when the sheet of paper is engaged with the stopped platen, for performing a sheet flexing and a sheet skew removing;

(c) driving the platen at a third speed lower than the second speed to feed the sheet of paper to a printing position.

3. A printing apparatus comprising:

a sheet feed roller for playing out piled sheets of paper one by one;

a platen disposed at a downstream side of a sheet feed passage from the sheet feed roller;

a sheet feed auxiliary roller disposed at the sheet feed passage between the sheet feed roller and the platen, for energizing the feed of the sheet of paper;

sheet detecting means disposed on the sheet feed passage between the sheet feed roller and the platen, for detecting that the sheet of paper approaches the platen; and driving means for forcibly driving the platen, sheet feed roller and sheet feed auxiliary roller, and for feeding the sheet of paper at a first speed until the sheet of paper is detected by the sheet detecting means, the platen being driven at a second speed lower than the first speed to feed the sheet of paper to a printing position after the passage of a required short time from a time when the leading end of the sheet of paper is engaged with the stopped platen, the driving means driving the sheet feed roller at the first speed and the sheet feed auxiliary roller at the first speed, at the second speed, and at a third speed lower than the second speed.

4. A printing apparatus according to claim 3, wherein the driving means drives the platen at the second or third speed.

5. A printing apparatus comprising:

a sheet feed roller for playing out piled sheets of paper one by one;

a platen disposed at a downstream side of a sheet feed passage from the sheet feed roller;

a sheet feed auxiliary roller disposed at the sheet feed passage between the sheet feed roller and the platen, for energizing the feed of the sheet of paper;

sheet detecting means disposed on the sheet feed passage between the sheet feed roller and the platen, for detecting that the sheet of paper approaches the platen; and driving means for forcibly driving the platen, sheet feed roller and sheet feed auxiliary roller, and for feeding the sheet of paper at a first speed in a downstream direction until the sheet of paper is detected by the sheet detecting means, the platen being driven at a second speed in the downstream direction lower than the first speed to feed the sheet of paper to a printing position after the passage of a required short time from a time when the leading end of the sheet of paper is engaged with the stopped platen.

6. A printing apparatus according to one of claims 4 to 4, wherein the feed force of the sheet feed auxiliary roller is set larger than that of the sheet feed roller by the driving means.

7. A printing apparatus according to claim 5, wherein the driving means includes a planetary gear mechanism selectively engaging with the sheet feed roller and the sheet feed auxiliary roller.

8. A printing apparatus according to claim 7, wherein the planetary gear mechanism further comprises:

a driving gear;

a lever; and a first, a second and a third planet gears rotatably attached by the lever such that the first, second and third planet gears engage with and revolve around the driving gear, wherein the second planet gear transmits a driving force to the sheet feed auxiliary roller and the third planet gear transmits a driving force to the sheet feed roller when the driving gear rotates forwardly, and wherein the first planet gear transmits a driving force to the sheet feed auxiliary roller when the driving gear rotates backwardly.

* * * * *